United States Patent [19]

Maliczyszyn et al.

[11] Patent Number: 4,872,951

[45] Date of Patent: Oct. 10, 1989

[54] STARCH BLENDS USEFUL AS EXTERNAL PAPER SIZES

[75] Inventors: Walter Maliczyszyn, Somerville; Henry R. Hernandez, Flemington, both of N.J.

[73] Assignee: National Starch and Chemical Corporation, Bridgewater, N.J.

[21] Appl. No.: 218,380

[22] Filed: Jul. 13, 1988

[51] Int. Cl.[4] ..... D21H 1/38

[52] U.S. Cl. ..... 162/135; 106/210; 106/213; 162/175; 427/395

[58] Field of Search ..... 162/175, 135; 106/210, 106/213; 427/395

[56] References Cited

U.S. PATENT DOCUMENTS

| | | | |
|---|---|---|---|
| 2,613,206 | 10/1952 | Caldwell | 260/233.5 |
| 2,661,349 | 12/1953 | Caldwell et al. | 260/224 |
| 2,813,093 | 11/1957 | Caldwell et al. | 260/233.3 |
| 2,989,520 | 6/1961 | Rutenberg et al. | 260/233.3 |
| 3,077,469 | 2/1963 | Aszalos | 260/233.3 |
| 3,542,707 | 11/1970 | Wilkinson | 162/167 |
| 3,674,725 | 7/1972 | Aiken et al. | 162/175 |
| 4,146,515 | 3/1979 | Buikema et al. | 162/168.2 |
| 4,239,592 | 12/1980 | Gaspar et al. | 162/175 |
| 4,627,889 | 12/1986 | Bernheim et al. | 162/175 |
| 4,687,519 | 8/1987 | Trzasko et al. | 106/211 |

FOREIGN PATENT DOCUMENTS

| | | | |
|---|---|---|---|
| WO8592635 | 6/1985 | PCT Int'l Appl. | 162/175 |

*Primary Examiner*—Peter Chin

*Attorney, Agent, or Firm*—Royal N. Ronning, Jr.; Edwin M. Szala

[57] ABSTRACT

This invention presents a series of blends of ASA-treated and cationic starches for use as external sizes of paper and paperboard products. The blends contain at least 30% (by wt) of the ASA-treated starch, which is a monoester of the starch and an alkyl or alkenyl succinate and, optionally, from about 0.5 to about 5% (by weight based on the starch) of an $Al^{3+}$ salt.

24 Claims, No Drawings

STARCH BLENDS USEFUL AS EXTERNAL PAPER SIZES

BACKGROUND OF THE INVENTION

Paper and paperboard are often externally sized with various materials for the purpose of increasing their strength, their resistance to picking and scuffing, and their resistance to undue penetration of water, organic solvents, oils, inks and various types of aqueous solutions as well as for the purpose of improving their smoothness and optical characteristics. When sizing materials are applied to the surface of a web or sheet in order to cement the surface fibers to the body of the paper and to modify the sheet surface, the process is known as external or surface sizing; the latter process being quite distinct from an internal sizing process wherein sizing agents are admixed with the pulp slurry prior to its being converted into web or sheet form, to reduce penetration of aqueous and other fluid into the paper.

Among various materials which have been utilized as external sizing agents are included conventional and modified starches, polyvinyl alcohol, cellulosic derivatives, gelatin, rosin, proteins such as casein, natural gums and synthetic polymers. Although these materials are effective to various degrees under certain conditions, their use is nonetheless subject to one or more limitations. For example, it is often necessary to utilize high concentration levels of such sizes in order to achieve the desired properties. Since it is known that the opacity and brightness of the base paper sheet decrease in proportion to the amount of size that is applied thereto, a direct result of the required use of such high concentration levels is a reduction in the optical properties of the treated paper. Furthermore, the use of such high concentration levels makes the sizing of specialty papers economically unattractive due to the high cost of quality sizes, e.g. specialty starches as well as other natural and/or synthetic polymers which are usually utilized for such purposes. In addition, certain sizing agents impart relatively poor water resistance and must be used in conjunction with insolubilizing agents to assure that satisfactory water resistance is obtained.

The use of hydrophobic starches as external sizing agents has been proposed (see e.g. U.S. Pat. No. 2,661,349 to Caldwell et al.), but the use of such agents is impractical due to their high viscosity; starches must be partially fluidized (degraded), prior to use, adding to their cost. To remedy this, Gaspar et al. (in U.S. Pat. No. 4,239,592, incorporated herein by reference) proposed using blends of non-hydrophobic and hydrophobic starches as external sizes. While such starch blends are used, the utility of such blends is limited, since, according to Gaspar, any increase in the amount of hydrophobic starch in the blend beyond 14% will not result in increased sizing properties. Because the degree of sizing is directly proportional to the amount of hydrophobic starch in the blend, the utility of the blends is limited to applications where the degree of sizing required is not high.

There exists a need for sizing compositions which do not exhibit these drawbacks, are relatively inexpensive, are easy to prepare, and impart desirable properties to the paper or paperboard substrate.

SUMMARY OF THE INVENTION

It is an object of this invention to present a series of starch blends (mixtures) suitable for use as surface sizes for paper and paperboard products. It is further an object of this invention to present surface sizes which provides improved water resistance and decreased porosity of the paper or paperboard substrate.

This invention presents a series of starch blends which fulfill these objects. The blends are comprised of 70 or less parts by weight of a conventional cationic (modified) size press starch and 40 or more parts by weight of modified starch prepared by reaction of a starch with an alkyl or alkenyl succinic anhydride (ASA), preferably 1-octenyl succinic anhydride (OSA), termed the ASA-treated starch. Such starch blends can be applied to paper and paperboard substrates by any conventional application means at a standard pickup rate, nominally 30–300 lbs/ton, and will impart the desirable sizing properties to the paper.

Because the starches which form the components of blend possess high inherent viscosities, they must partially degraded (fluidized) prior to use in the blend. This degradation is ordinarily performed by chemical methods using the conventional techniques, such as acidification or oxidation, which are well known to those is the art. Enzyme modification can also be to degrade.

It has also been found that the addition of small amounts, generally 0.5 to 5% (by weight, based on the weight of the starch), of $Al^{3+}$ salts to the sizing mixture also will enhance the water resistance and decrease the porosity of paper and paperboard substrates treated with the starch blends of this invention beyond that achieved by the blends alone. In this way, products with superior sizing properties can be obtained.

DETAILED DESCRIPTION OF THE INVENTION

The base starches which can be used in preparing both the ASA-treated and cationic starch components may be derived from any plant source including corn, potato, sweet potato wheat, rice, sago, tapioca, waxy maize, sorghum, high amylose corn, or the like. Additionally, conversion products derived from any of these bases can be employed, including, for example, dextrins prepared by the hydrolytic action of acid and/or heat; oxidized starches prepared by treatment with oxidants such as sodium hypochlorite; and fluidity or thin boiling starches prepared, for example, by enzyme conversion or mild acid hydrolysis. If the desired starch blend is to be a granular starch then obviously the initial starting material must be in granular form. However, the starch blend compositions of this invention may also be prepared employing gelatinized starches, i.e. nongranular starches.

The ASA-treated starches useful as sizes herein are preferably starch monoesters of octenyl succinate, prepared by the reaction of the starch with 1-octenyl succinic anhydride, as described in U.S. Pat. No. 2,661,349 to Caldwell et al., incorporated herein by reference. Other useful ASA-treated starches can be produced by similar reactions with other alkyl and alkenyl succinic anhydrides such as decyl or decenyl succinic anhydride and dodecyl or dodecenyl succinic anhydride, wherein the alkyl or alkenyl group is preferably $C_{5-14}$.

With regard to the degree of substitution (D.S.) which is required in the ASA-treated starches suitable for use in the starch blends herein, the selected starch base should be reacted with sufficient alkenyl succinic anhydride reagent in order that the resulting starch ester has a degree of substitution i.e., the number of ester substituent groups per anhydroglucose unit of the starch molecule, ranging from about 0.005 to 0.10 preferably from 0.01 to 0.05, and more preferably 0.0245 to 0.044.

The cationic starches, which form the other component in the starch blend, are prepared, for example, by reacting starch through an etherification or esterification reaction with any reagent which will introduce a cationic group containing nitrogen, sulfur or phosphorus therein. Examples of such groups are the amine (primary, secondary, tertiary, or quaternary), sulfonium and phosphonium groups. The preferred cationic starch derivative is the tertiary amino alkyl esther resulting from the reaction of a starch under alkaline conditions, with a dialkyl amino alkyl halide. The general method for the preparation of such products is described in U.S. Pat. No. 2,813,093, issued Nov. 12, 1957; the cationic starch may also be prepared as described in U.S. Pat. No. 3,674,725, issued July 4, 1972. Both patents are incorporated herein by reference.

While the tertiary amino alkyl ethers of starch are preferred, the primary and secondary amine derivatives as well as the corresponding starch esters may also be used. Thus, beside the reagents already named, a cationic starch product can be prepared by reaction of a starch with amino alkyl anhydrides, amino alkyl epoxides or halides, and the corresponding compounds containing aryl in addition to alkyl groups. Furthermore, one may also employ tertiary amino alkyl ethers of starch which also contain either hydroxyethyl, hydroxypropyl, etc., groups or ester, e.g. acetate, sulfate, phosphate, etc., groups. Such difunctional derivatives may be prepared by subjecting a starch to a hydroxyalkylation or esterification reaction along with the requisite aminoalkylation reaction in a procedure whereby the two reactions may be conducted simultaneously or in any desired order.

Further, the starch-amine products may be subsequently treated by known methods so as to result in the quaternary ammonium salt, or, such a quaternary ammonium salt may be made directly from a starch, for example, by treating it with the reaction product of an epihalohydrin and a tertiary amine or tertiary amine salt. In either case, the resulting starch derivative is cationic in nature and is suitable for use in the starch blend compositions and processes of this invention.

The general preparation of sulfonium derivatives is described in U.S. Pat. No. 2,989,520, issued June 20, 1961 and incorporated herein by reference and involves essentially the reaction of starch with a betahalogeno alkyl sulfonium salt, vinyl sulfonium salt or epoxy alkyl sulfonium salt. The general preparation of phosphonium derivatives is described in U.S. Pat. No. 3,007,469, (also incorporated herein by reference) issued Feb. 12, 1963, and involves essentially the reaction of starch with a beta-halogeno alkyl phosphonium salt. Other suitable derivatives will be apparent to the practitioner, since the starch blends of the invention may employ any starch derivatives which have been rendered cationic by the introduction of an electrically positively charged moiety into the starch molecule.

With regard to the degree of substitution which is required in the cationic starch derivatives suitable for use in the starch blends herein, it is advisable to react the selected starch with sufficient cationic reagent in order that the resulting cationic starch derivatives exhibit a degree of substitution ranging from about 0.01 to 0.20, and preferably from 0.02to 0.10.

The starch blends of this invention contain at least 30% (by wt.) ASA-treated starch and 70% (by wt) or less cationic starch. Preferably, the ratio (wt/wt) of ASA-treated to cationic starch ranges from 30/70 to 90/10, more preferably 30/70 to 80/20.

The starch blends of this invention may be successfully utilized for the sizing of paper prepared from both cellulosic and combinations of cellulosic with noncellulosic fibers. The hardwood or soft wood cellulosic fibers which may be used include bleached and unbleached. sulfate (Kraft), bleached and unbleached sulfite, bleached and unbleached soda, neutral sulfite semichemical, chemi-groundwood, groundwood, and any combination of these fibers. These designations refer to wood pulp fibers which have been prepared by means of a variety of processes which are used in the pulp and paper industry. In addition, synthetic cellulose fibers of the viscose rayon or regenerated cellulose type can also be used, as well as recycled waste papers from various sources.

All types of paper dyes and tints, pigments and fillers may be added to the paper (in the usual manner) which is to be sized by the blends of this invention. Such materials include clay, talc, titanium dioxide, calcium carbonate, calcium sulfate, and diatomaceous earths. The paper can contain other additives, including rosin, alum, and internal sizing compositions such as alkenyl succinic anhydride and alkyl ketene dimer. Other surface sizing agents as well as pigments, dyes and lubricants can also be used in conjunction with the size blends described herein. The base paper used can be acid or alkaline grade.

With regard to forming the starch blends for use, they may be formed by mixing the ASA-treated cationic starches in dry form, or adding one dry component to the aqueous dispersion of the second component, or, appropriate amounts of aqueous dispersions of these starches may be combined to form the final starch dispersion. The actual use of the ASA-treated/cationic starch blends described herein involves dispersing the blend in water at a concentration of about 2.0 to 20.0%, preferably 3.0 to 8.0%, dry basis. As is well known to those skilled in the art, suitable conditions must be selected by the practitioner to prevent undesired decompositions of the hydrophobic starch esters. For example, cooking at high pH levels will result in hydrolysis of the ester linkage, while cooking at very low pH levels may result in hydrolysis of the starch molecule.

The starch size dispersion is then applied to the surface of a previously prepared paper or paperboard web by means of any conventional surface sizing technique. Included among these techniques are size press, tub, gate roll applicators and calendar stack sizing procedures. Thus, for example, in a size press technique, surface sizing is accomplished by passing the web of paper between a pair of press rolls wherein the lower roll of the pair is rotating in a batch of the sizing dispersion. The surface of this roll picks up size and deposits it on the lower surface of the web. If desired, sizing may also be applied to the upper surface of the web by spraying it into the nip formed between the web and the upper roll, or by spraying it against the surface of the upper roll and allowing it to accumulate on the upper surface of the web as it enters the press. The sized webs are then dried by means of any conventional drying operation selected by the practitioner.

The cationic/ASA-treated starch blends are ordinarily employed in amounts to provide a size concentration ranging from 1.5 to 15.0% of the weight of the finished dry paper. Within this range, the precise amount which is used will depend for the most part upon the type of pulp which is being utilized, the specific operating conditions, as well as the particular end use for which paper is destined.

The blends thus formulated and applied to the paper or paperboard substrate will result in a substrate having a decreased pore size as well as satisfactory sizing, i.e. resistance to water and/or aqueous ink solutions.

It has further been found that the addition of small (0.5 to 5%, preferably 2–4%, more preferably 2.5–3.5%, by weight) of an $Al^{3+}$salt to the blend will enhance these properties. This $Al^{3+}$salt is preferably $AlCl_3$, but can be any aluminum salt compatible with the starch blends including, but not limited to, other $Al^{3+}$ halides, alum ($Al_2(SO_4)_3$), and aluminum acetate. The use of salts of other transition metals, such as tin (Sn) is also contemplated.

This enhancement of properties with the addition of $Al^{3+}$ salts is particularly noticeable when the starch blends are applied to alkaline (internally sized) grade papers. In such papers the application of the starch blends alone will only have a moderate effect on the properties; however when even small amounts of $Al^{3+}$ salts are added; the porosity is remarkably decreased while the internal sizing is enhanced. When acid grade papers are used, the difference is much less pronounced and the application of the starch blends alone produces highly desirable results.

EXAMPLES

The following examples further illustrate certain preferred embodiments of the invention and are not intended to be illustrative of all embodiments.

In each experiment, paper substrates treated with the blended starch size compositions of the instant invention were examined for water resistance (sizing) and pore size in the following tests.

a. Hercules Size Test (HST) - this test measures the degree of resistance to penetration of aqueous ink of the sized paper. Briefly, the underside of a sized paper sheet is examined for light reflectance in a photovoltaic cell; this is the baseline 100% reflectance. Subsequently, the upper surface of the paper is brought into contact with an aqueous green ink at a pH of 2.6, and the reflectance of the underside is continuously monitored. The time required for the reflectance to be reduced to 80% of the baseline value (in seconds) is recorded.

This time is a measure of the aqueous ink penetration resistance of the paper, and hence the degree of sizing, since it is based on the rate and which the ink penetrates the paper and affects the opposite surface. Thus, samples with longer HST times exhibit superior sizing properties.

b. Gurley Density - this test is a measure of the air resistance (or porosity) of a sized paper sheet, which is conducted in accordance with TAPPI Standard Method T 460-OM-86, entitled "Air Resistance of Paper". Briefly, a sample of the sized paper having an area of 1 $in^2$ (6.45 $cm^2$) is placed at the outlet end of an apparatus containing an open cylinder filled with air at ambient pressure (1 atm). The air is then forcibly expelled through the paper under the weight of the cylinder; the time for 100 cc of air to pass through the sample is recorded.

This time is a relative measure of paper porosity, and the more porous papers will have lower Gurley Density times. In general, the better external sizes will produce papers with lower porosity.

For each test, the paper substrates were treated with the desired sizing blend in a standard laboratory double-rolled, horizontal size press to the desired pick up rate. The sized paper was then dried and subjected to the above determinations.

EXAMPLE 1

Use of ASA-treated Starch Blends on Acid Grade Paper

In order to examine the effects of preconverted OSA treated ASAtreated starch/preconverted cationic starch blends, a series of such blends using various proportions of cationic to ASA treated starch were prepared using OSa treated starches treated with 2.45, 4.4, and 7.4% (by wt) OSA. These blends were applied to an internally sized acid grade paper. The results are presented in Table I.

TABLE I

| Blend (cationic/ ASA-treated) | Pickup Rate (#/ton) | | HST (sec) | | Gurley Density (sec) | |
|---|---|---|---|---|---|---|
| (by wt.) | w/o $AlCl_3$ | w/2% $AlCl_3$ | w/o $AlCl_3$ | w/2% $AlCl_3$ | w/o $AlCl_3$ | w/2% $AlCl_3$ |
| ASA-treated Starch treated with 2.45% OSA (by wt) | | | | | | |
| 90/10 | 138 | 142 | 237 | 180 | 16 | 16 |
| 80/20 | 144 | 140 | 256 | 201 | 24 | 22 |
| 70/30 | 142 | 143 | 330 | 214 | 152 | 490 |
| 50/50 | 144 | 148 | 318 | 226 | 88 | 174 |
| 20/80 | 140 | 138 | 339 | 237 | 90 | 374 |
| ASA-treated Starch treated with 4.4% OSA (by wt) | | | | | | |
| 90/10 | 140 | 132 | 390 | 186 | 20 | 17 |
| 80/20 | 146 | 110 | 380 | 281 | 47 | 40 |
| 70/30 | 133 | 126 | 356 | 250 | 58 | 91 |
| 50/50 | 140 | 128 | 343 | 315 | 145 | 166 |
| 20/80 | 110 | 98 | 400 | 310 | 104 | 195 |
| ASA-treated Starch treated with 7.4% OSA (by wt) | | | | | | |
| 90/10 | 136 | 138 | 330 | 135 | 18 | 25 |
| 80/20 | 135 | 138 | 390 | 300 | 47 | 27 |
| 70/30 | 135 | 136 | 480 | 360 | 108 | 38 |
| 50/50 | 126 | 140 | 565 | 415 | 162 | 69 |

TABLE I-continued

| Blend (cationic/ ASA-treated) (by wt.) | Pickup Rate (#/ton) w/o $AlCl_3$ | Pickup Rate (#/ton) w/2% $AlCl_3$ | HST (sec) w/o $AlCl_3$ | HST (sec) w/2% $AlCl_3$ | Gurley Density (sec) w/o $AlCl_3$ | Gurley Density (sec) w/2% $AlCl_3$ |
|---|---|---|---|---|---|---|
| 20/80 | 145 | 127 | 580 | 400 | 245 | 110 |

[a]% by weight based on the dry weight of the starch

The data reveals that both the HST sizing and the Gurley density are increased with the blends are used as external size compositions; in general, these properties are increased as the % ASA-treated starch in the blend is increased. The only notable exceptions are the extremely high Gurley density in the 70/30 blend of the 2.45% series and the 20/80 blend of the 7.4% series which may be attributed to experimental error. This trend is seen regardless of the OSA level used.

When 2% $AlCl_3$ was added, the Gurley density was increased, while the HST sizing was reduced for all blends at the 2.45 and 4.4% treatment levels. At 7.4%, both the HST sizing and Gurley density were reduced indicating that at these high OSA levels, the $AlCl_3$ had no positive effects.

EXAMPLE 2

Use of Other Anionic Starches in the Sizing Blends

To examine the use of different ASA-treated starches (other than ASA treated) in the starch sizing blends, series of blends were made using the preconverted cationic starch of Example 1 and various anionic starches; sodium tripolyphosphate (STP), N-(2-chloroethyl-)imino-bis-(methylene diphosphonic acid) (CMPA), and 3-chloro-2-sulfopropionic acid (CSPA) were the reagents used to prepare the anionic starches. The paper was the internally sized acid grade paper used in Example 1. The results are presented in Table II.

TABLE II

| Blend (cationic/ ASA-treated) (by wt.) | Pickup Rate (#/ton) w/o $AlCl_3$ | Pickup Rate (#/ton) w/2% $AlCl_3$ | HST (sec) w/o $AlCl_3$ | HST (sec) w/2% $AlCl_3$ | Gurley Density (sec) w/o $AlCl_3$ | Gurley Density (sec) w/2% $AlCl_3$b |
|---|---|---|---|---|---|---|
| Anionic treated Starch treated with STP to 0.25 P[a] (by wt) | | | | | | |
| 90/10 | 106 | 105 | 310 | 124 | 12 | 14 |
| 80/20 | 135 | 112 | 69 | 103 | 16 | 26 |
| 70/30 | 140 | 111 | 32 | 50 | 22 | 55 |
| 50/50 | 132 | 104 | 16 | 18 | 24 | 70 |
| 20/80 | 130 | 105 | 8 | 5 | 22 | 49 |
| Anionic Starch treated with STP to 0.32 P[a] (by wt) | | | | | | |
| 90/10 | 144 | 112 | 60 | 118 | 15 | 14 |
| 80/20 | 146 | 112 | 13 | 93 | 22 | 17 |
| 70/30 | 146 | 104 | 30 | 65 | 20 | 48 |
| 50/50 | 142 | 120 | 20 | 16 | 23 | 68 |
| 20/80 | 142 | 142 | 8 | 7 | 22 | 31 |
| Anionic Starch treated with STP to 0.5% P[a] (by wt) | | | | | | |
| 90/10 | 125 | 116 | 80 | 130 | 15 | 20 |
| 80/20 | 142 | 112 | 60 | 85 | 23 | 27 |
| 70/30 | 133 | 112 | 28 | 55 | 23 | 38 |
| 50/50 | 127 | 104 | 9 | 21 | 21 | 50 |
| 20/80 | 154 | 160 | 4 | 10 | 23 | 36 |
| Anionic Starch treated with CMPA to 0.36 P[a] (by wt) | | | | | | |
| 90/10 | 137 | 129 | 140 | 185 | 16 | 15 |
| 80/20 | 128 | 138 | 150 | 187 | 32 | 16 |
| 70/30 | 126 | 124 | 160 | 160 | 54 | 29 |
| 50/50 | 124 | 140 | 100 | 165 | 100 | 94 |
| 20/80 | 128 | 158 | 80 | 120 | 75 | 193 |
| Anionic Starch treated with CMPA to 0.87 P (by wt) | | | | | | |
| 90/10 | 137 | 140 | 155 | 285 | 20 | 18 |
| 80/20 | 135 | 130 | 135 | 145 | 33 | 28 |
| 70/30 | 128 | 112 | 100 | 165 | 54 | 68 |
| 50/50 | 128 | 124 | 57 | 135 | 63 | 113 |
| 20/80 | 124 | 109 | 22 | 80 | 55 | 322 |
| Anionic Starch treated with 4.4% CSPA (by wt) | | | | | | |
| 90/10 | 139 | 146 | 176 | 165 | 13 | 10 |
| 80/20 | 150 | 154 | 174 | 150 | 18 | 13 |
| 70/30 | 148 | 150 | 405 | 160 | 13 | 11 |
| 50/50 | 133 | 145 | 445 | 150 | 11 | 11 |
| 20/80 | 120 | 135 | 153 | 160 | 10 | 10 |
| ASA-treated Starch treated with 6.3% CSPA (by wt) | | | | | | |
| 90/10 | 135 | 130 | 160 | 170 | 13 | 14 |
| 80/20 | 144 | 121 | 165 | 135 | 14 | 13 |
| 70/30 | 142 | 133 | 125 | 170 | 12 | 11 |
| 50/50 | 144 | 138 | 185 | 155 | 14 | 12 |
| 20/80 | 132 | 130 | 185 | 140 | 11 | 11 |

[a]Percentages based on bound phosphate
[b]% by weight based on the dry weight of the starch The data reveals that none of these treated anionic starches impart the same properties to the size blend as does the OSA treated starch, alone or when 2% $AlCl_3$ is added. In fact, in most cases the increase of the proportion of the anionic starches in the blend decreases both HST sizing and Gurley density. The CMPA treated blends appear to achieve a desirable porosity, but the HST sizing decreases as the % CMPA treated starch in the blend is increased.

EXAMPLE 3

Use of ASA-treated Starch Blends on Alkaline Grade Paper

This experimental series examined the properties of blends prepared from OSA treated starches on another paper, namely an internally sized alkaline grade paper. Briefly, the blends were prepared, in 10% intervals, using OSA (2.45%, by wt) treated ASA-treated starch and the preconverted fluidity based cationic starch of Example 1; a parallel series of determinations were made using the same blends and also employing 4% $AlCl_3$ as an additive. The results are presented in Table III.

TABLE III

| Blend (cationic/ ASA-treated) (by wt.) | Pickup Rate (#/ton) w/o $AlCl_3$ | Pickup Rate (#/ton) w/2% $AlCl_3$ | HST (sec) w/o $AlCl_3$ | HST (sec) w/2% $AlCl_3$ | Gurley Density (sec) w/o $AlCl_3$ | Gurley Density (sec) w/2% $AlCl_3$b |
|---|---|---|---|---|---|---|
| 100/0 | | 104 | 35 | 254 | 8 | 9 |
| 90/10 | | 110 | 27 | 250 | 8 | 11 |
| 80/20 | | 96 | 28 | 284 | 9 | 13 |
| 70/30 | | 110 | 21 | 290 | 10 | 22 |
| 60/40 | | 105 | 52 | 286 | 10 | 34 |
| 50/50 | | 112 | 11 | 375 | 11 | 50 |
| 40/60 | | 122 | 11 | 372 | 11 | 81 |
| 30/70 | | 120 | 12 | 442 | 12 | 110 |
| 20/80 | | 140 | 10 | 390 | 10 | 100 |
| 10/90 | | 147 | 8 | 425 | 8 | 157 |
| 0/100 | | 143 | 10 | 371 | 10 | 155 |

[a]% by weight based on the dry weight of the starch

The data reveals that treatment of this paper with sizing blend gives the paper enhanced size and porosity properties when the ASA-treated component comprises at least 30% of the size composition; this enhancement is particularly noticeable when the 4% $AlCl_3$ was added. Thus, the paper can be satisfactorily coated with the neat blend, but use of $AlCl_3$ provides a significantly enhancement in the desirable properties.

It is apparent that many variations and modifications oof the invention as hereinabove set forth may be made without departing from the spirit and scope thereof. The specific embodiments described are given by way of example only and the invention is limited only by the terms of the appended claims.

What is claimed is:

1. An external size composition comprising a starch blend which comprises an admixture of 10–70% (by wt) of a cationic starch and 30–90% (by wt) of an ASA-treated starch, said ASA-treated starch being a monoester of an alkenyl succinate.

2. The composition of claim 1 wherein the alkenyl succinate is 1-octenyl succinate.

3. The composition of claim 1 wherein the ratio (wt/wt) of ASA-treated to cationic starch ranges from 30/70 to 80/30.

4. The composition of claim 1 wherein the ASA-treated starch has a degree of substitution from about 0.005 to about 0.10.

5. The composition of claim 1 wherein the cationic starch is selected from the group consisting of tertiary amino alkyl starch derivatives and quaternary ammonium starch derivatives.

6. The composition of claim 5 wherein the cationic starch is a tertiary amino alkyl ether starch derivative.

7. The composition of claim 5 wherein the cationic starch has a degree of substitution of about 0.01 to about 0.20.

8. The composition of claim 1 which further comprises from about 0.5 to about 5% (by weight based on the starch) of an $Al^{3+}$ salt.

9. The composition of claim 8 wherein the $Al^{3+}$ salt is selected from the group consisting of aluminum trihalides, alum, and aluminum acetate.

10. The composition of claim 9 wherein the $Al^{3+}$ salt is $AlCl_3$.

11. In a process of external sizing of paper or paperboard the improvement which comprises the step of applying to the surface thereof an effective amount of a starch blend which comprises an admixture of 10–70% (by wt) of a cationic starch and 30–90% by wt and and 30–90% (by wt) of an ASA-treated starch, said ASA-treated starch being a monoester of an alkenyl succinate, such that the pore size of said paper or paperboard is reduced while the water resistance remains unchanged or is enhanced.

12. The process of claim 11 wherein the alkenyl succinate is 1-octenyl succinate.

13. The process of claim 11 wherein the ration (wt/t/wt) of ASA treated to cationic starch ranges from 30/70 to 80/20.

14. The process of claim 11 wherein the ASA-treated starch has a degree of substitution from about 0.005 to about 0.10.

15. The process of claim 11 wherein the cationic starch is selected from the group consisting of tertiary amino alkyl starch derivatives and quaternary ammonium starch derivatives.

16. The process of claim 11, wherein the cationic starch is a tertiary amino alkyl ether starch derivative.

17. The process of claim 11 wherein the cationic starch has a degree of substitution of about 0.01 to about 0.20.

18. The process of claim 11 wherein the solids concentration of the starch in the aqueous dispersion ranges from about 2 to about 20% (by wt).

19. The process of claim 11 wherein the amount of starch blend applied to the paper ranges from about 1.5 to about 15% (by wt) based on the finished dry paper.

20. The process of claim 11 which further comprises adding to the starch blend, about 0.05 to about 5% (by wt based on the starch) of an $Al^{3+}$salt.

21. The process of claim 20 wherein $Al^{3+}$ salt is selected from the group consisting of aluminum trihalides, alum, and aluminum acetate.

22. The process of claim 21 wherein the $Al^{3+}$ salt is $AlCl_3$.

23. A paper or paperboard product sized by the process of claim 11.

24. A paper or paperboard product sized by the process of claim 20.

* * * * *